United States Patent [19]

Ebinuma et al.

[11] Patent Number: 4,744,337

[45] Date of Patent: May 17, 1988

[54] PORTABLE ENGINE

[75] Inventors: Takanori Ebinuma; Hiroshi Kato; Mituko Sakurai, all of Tokyo, Japan

[73] Assignee: Komatsu Zenoah Co., Japan

[21] Appl. No.: 917,033

[22] Filed: Oct. 9, 1986

[30] Foreign Application Priority Data

| | | | |
|---|---|---|---|
| Oct. 9, 1985 | [JP] | Japan | 60-153635[U] |
| Dec. 5, 1985 | [JP] | Japan | 60-186619[U] |
| Feb. 27, 1986 | [JP] | Japan | 61-026543[U] |
| Mar. 17, 1986 | [JP] | Japan | 61-037470[U] |

[51] Int. Cl.[4] ..... F01P 7/04

[52] U.S. Cl. ..... 123/41.66; 123/41.7

[58] Field of Search ..... 123/41.65, 41.66, 41.7

[56] References Cited

U.S. PATENT DOCUMENTS

| | | | |
|---|---|---|---|
| 2,693,789 | 11/1954 | Lechtenberg | 123/41.65 |
| 3,581,717 | 6/1971 | Fullerton | 123/41.65 |
| 4,483,279 | 11/1984 | Kohler et al. | 123/41.65 |

*Primary Examiner*—E. Rollins Cross

*Attorney, Agent, or Firm*—Wigman & Cohen

[57] ABSTRACT

A portable engine has a fan cover fixed to a front surface of a crankcase to cover a fan and to guide upward a blown stream of air generated by the fan, and a cylinder cover disposed behind and in series with the fan cover to cover an engine cylinder and to guide the blown stream toward the engine cylinder. The portable engine has a partition plate formed integrally with said crankcase to cover a step formed between the fan cover and the cylinder cover, and an ignition coil is fixed to the partition plate. According to this arrangement, heat of the engine cylinder will not be directly transmitted to the ignition coil to cause deterioration of the function of the ignition coil.

6 Claims, 9 Drawing Sheets

PORTABLE ENGINE

BACKGROUND OF THE INVENTION

1. Field of the Invention

The present invention relates to a portable engine adopted for a portable working apparatus such as a weed cutter.

2. Description of the Prior Art

In a prior art portable engine, an ignition coil for generating an electromotive force is generally fixed to the side face of an engine cylinder through a fitting seat and a tightening bolt. During the operation of engine, heat which is generated in the engine cylinder is transmitted to the ignition coil through the fitting seat and bolt and causes a deterioration in the function of ignition coil. The portable engine is also provided with a fan for cooling the engine cylinder. Air blown from the fan is firstly guided upward by a fan cover fixed to the front side (an output side of the engine) of a crankcase and then toward the periphery of the engine cylinder by a cylinder cover which is formed in series with the fan cover. A partition is provided to cover a step which is formed between the fan cover and the cylinder cover. According to the prior art, this partition is formed integrally with the cylinder cover.

SUMMARY OF THE INVENTION

An object of the present invention is to provide a compact engine which can prevent heat from being transmitted from an engine cylinder to an ignition coil to eliminate the functional deterioration of the ignition coil.

Briefly described, in order to accomplish the object and advantages mentioned in the above, the present invention provides a compact engine which comprises a partition formed integrally with a crankcase to cover a step between a fan cover and a cylinder cover, and an ignition coil fixed to the partition.

BRIEF DESCRIPTION OF THE DRAWINGS

These and other objects, features and advantages of the present invention will become apparent from the following descriptions of preferred embodiments taken in conjunction with the accompanying drawings in which.

DETAILED DESCRIPTION OF THE PREFERRED EMBODIMENTS

Preferred embodiments of the present invention will now be described with reference to the drawings, in which like numerals represent like parts.

Figure 1:
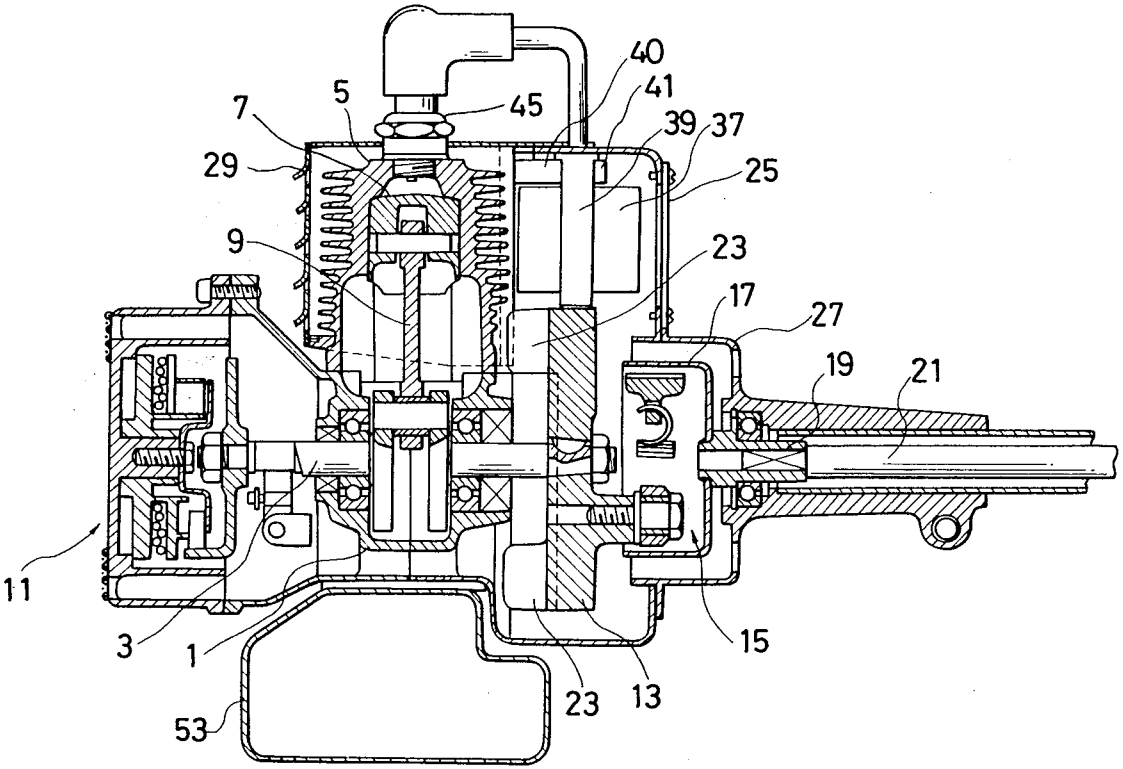
FIG. 1 is a cross-sectional side view showing a portable engine according to the present invention.
Figure 2:
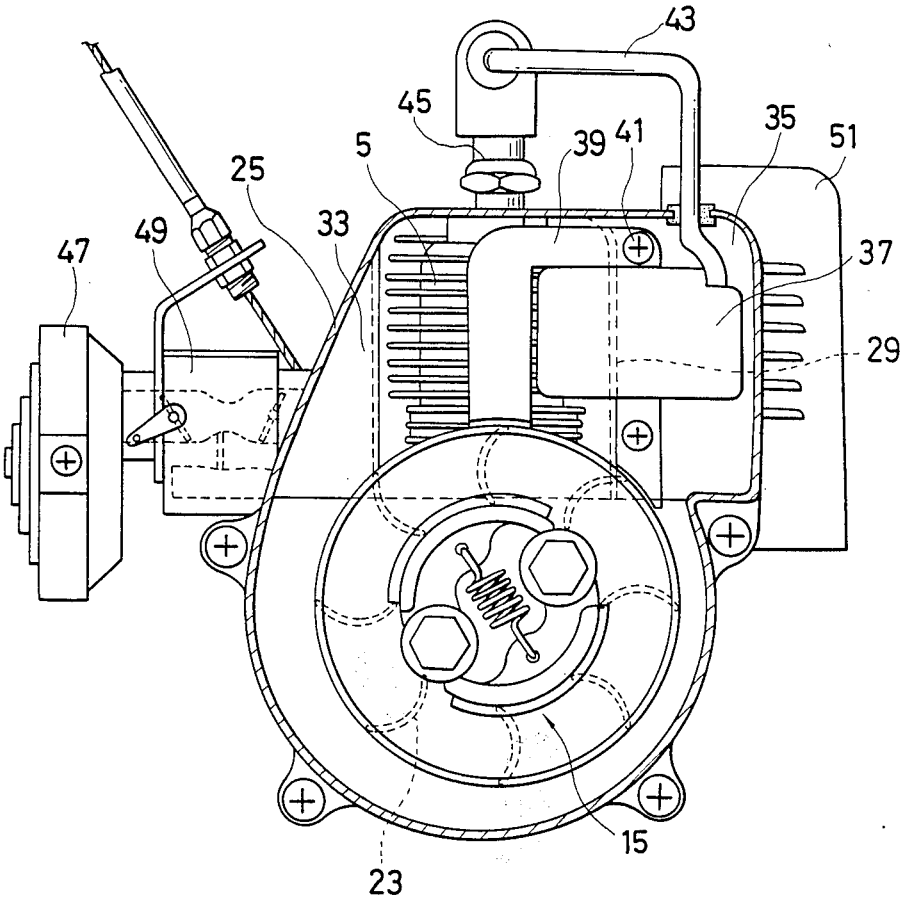
FIG. 2 is a front view partly broken showing the portable engine shown in FIG. 1.
Figure 3:
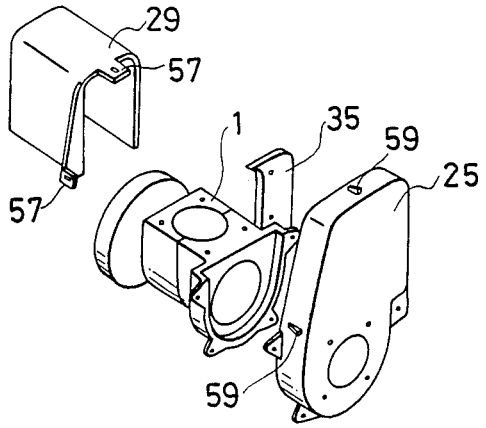
FIG. 3 is an exploded perspective view showing the portable engine.

FIGS. 1 to 3 show a portable engine according to an embodiment of the present invention. In the figures, a crankcase 1 of the engine includes a crank shaft 3 supported horizontally. An engine cylinder 5 is fixed on top of the crankcase 1 and houses a piston 7 which is freely slidable within the engine cylinder 5 and connected to the crank shaft 3 by a connecting rod 9. A recoil starter 11 is fitted to the rear end of the crank shaft 3, and a magnet wheel 13 is fixed to the front end of the crank shaft 3. A centrifugal clutch 15 is fitted to the front side of the magnet wheel 13. A clutch drum 17 is disposed closely to the periphery of the centrifugal clutch 15. A transmission shaft 21 is engaged with a boss 19 of the clutch drum 17.

A fan 23 having a plurality of fins is fixed to the rear side of the magnet wheel 13. A fan cover 25 for covering the fan 23 is fixed to the front side of the crankcase 1 to guide air blown by the fan 23 upward firstly and then rearward. A clutch housing 27 for covering the clutch drum 17 and for supporting the boss 19 is fixed to the front face of the fan cover 25. A cylinder cover 29 covers both sides of the engine cylinder 5 and is positioned in series with the fan cover 25 to guide the blown air toward the periphery of the engine cylinder 5.

A partition 33 for covering a step formed on one side of the fan cover 25 and the cylinder cover 29 is integrally formed with the cylinder cover 29. A partition 35 for covering another step formed on the other side of the fan cover 25 and the cylinder cover 29 is integrally formed with one side of the crankcase 1 and projects upward. An ignition coil 37 has an iron core 39 which is fixed to the partition 35 by screws 41 through a supporting cylinder 40. An end face of the iron core 39 is located adjacent to the periphery of the magnet wheel 13 to generate an electric current in response to magnets embedded in the periphery of the magnet wheel 13. The current in the ignition coil 37 is transmitted through a cable 43 to an ignition plug 45 located on top of the engine cylinder 5, and discharged from the ignition coil 37.

A carburetor 49 having an air cleaner 47 is fitted to one side of the engine cylinder 5, and a muffler cover 51 including a muffler (not shown) is fitted to the other side of the engine cylinder 5. A fuel tank 53 is fitted to the bottom of the crankcase 1.

According to the above arrangement, the fan 23 generates a blow stream according to the rotation of the engine. The blow stream is guided by the fan cover 25 and the cylinder cover 29 and sent toward the engine cylinder 5 to cool the engine cylinder 5. Heat of the engine cylinder 5 will not be transmitted to the ignition coil 37 directly because the ignition coil 37 is not directly fitted to the engine cylinder 5 but fixed to the partition 35 which is formed integrally with the crankcase 1. Therefore, the ignition coil 37 is not heated to high temperature. According to the present invention, the engine may be placed horizontally or upside down.

As shown in FIG. 1, an area of the fan cover 25 is cut to form an opening which is usually covered by a cap plate with screws. The cap plate can be removed from the fan cover 25 by loosening the screws as and when required to clean or replace the ignition coil 37, or to adjust a gap between the iron core 39 and the periphery of the magnet wheel 13.

Figure 4:
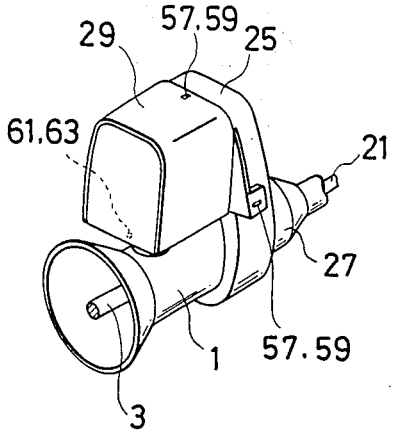
FIG. 4 is a perspective view showing the portable engine after assembling.

As shown in FIGS. 1, 3 and 4, stopper holes 57 are formed on a fitting surface of the cylinder cover 29, and stopper nails 59 corresponding to the stopper holes are projectingly formed on a fitting surface of the fan cover 25. Further, a positioning hole 61 is provided on a rear surface of the engine cylinder 5, and a positioning pin 63 is formed at a corresponding position inside the cylinder cover 29. The cylinder cover 29 may easily be fitted to and removed from the fan cover 25 through the engagement and disengagement of the stopper holes 57 and the stopper nails 59 with the positioning hole 61 and the positioning pin 63 acting as positioning means so that the engine cylinder 5 and its peripheral portion may easily be inspected as and when required.

Figure 5:
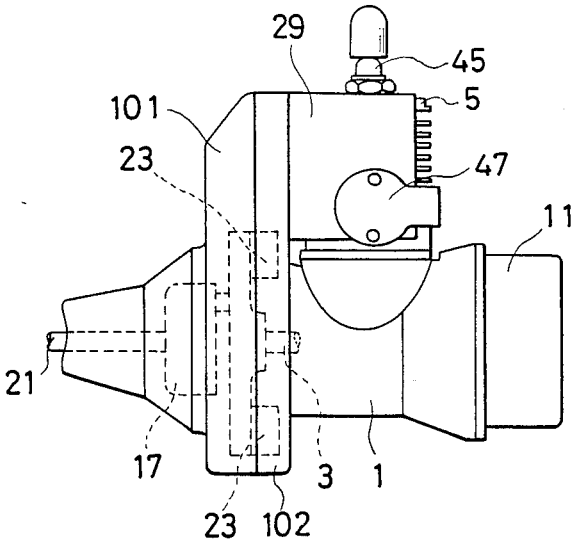
FIG. 5 is a side view showing a modification of a fan cover of the portable engine.
Figure 6:
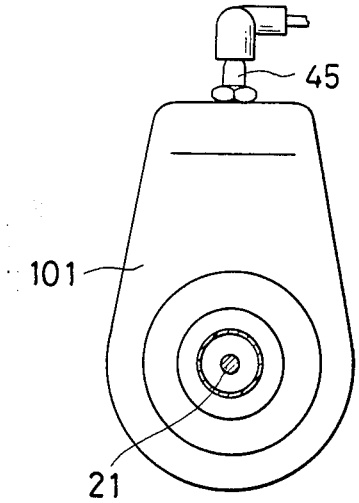
FIG. 6 is a front view showing the fan cover shown in FIG. 5.
Figure 7:
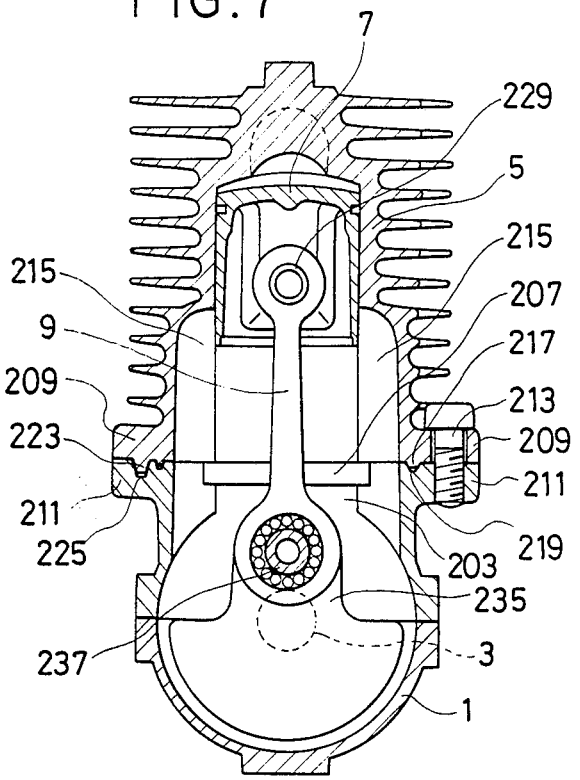
FIG. 7 is a cross-sectional front view showing the details of an engine cylinder of the portable engine.
Figure 8:
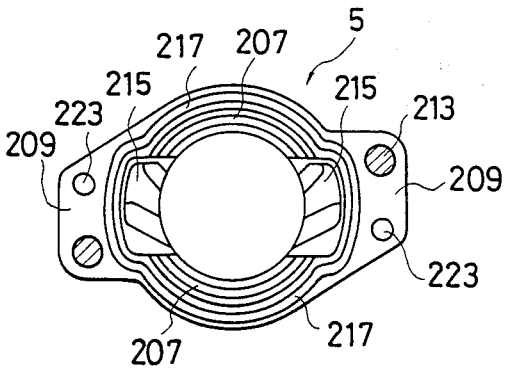
FIG. 8 is a plan view showing an essential part of the engine cylinder shown in FIG. 7.
Figure 9:
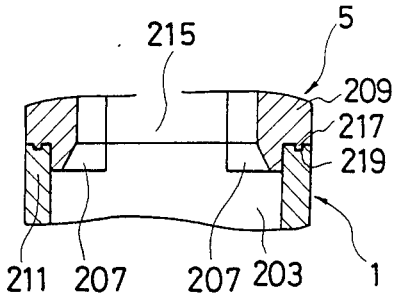
FIG. 9 is a cross-sectional front view showing the essential part of the engine cylinder.
Figure 10:
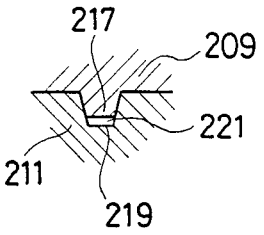
FIG. 10 is an enlarged cross-sectional view showing a fitting projection and a fitting groove of the engine cylinder.
Figure 11:
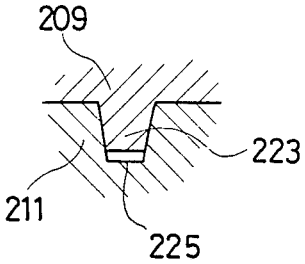
FIG. 11 is an enlarged cross-sectional view showing a positioning projection and a positioning hole of the engine cylinder.

FIGS. 5 and 6 show a modification of the above embodiment. In this modification, a flange 102 formed integrally with one end of the crankcase 1 has a front side face which entirely fits to a contacting face of a fan cover 101 and a rear side face which is attached to the cylinder cover 29. The fan cover 101 is fixed to the flange 102 by screws. According to this arrangement, the entire periphery of the fan cover 101 is rigidly fixed to the flange 102 of the crankcase 1 so that the fan cover 101 may vibrate less in operation, and the strength of the fan cover 101 improved.

FIGS. 7 to 11 show the details of the engine cylinder 5. The crank case 1 has at its upper end a circular opening 203 which is engaged with an arcuate spigot 207 formed at a lower end of the engine cylinder 5. A cylinder flange 209 of the engine cylinder 5 is aligned with a case flange 211 of the crankcase 1, and they are fastened by bolts 213. The engine cylinder 5 and the crankcase 1 is provided with scavenging grooves 215 which extend axially and face each other.

On a flange surface of the cylinder flange 20, a projection 217 projects continuously along the peripheries of the opening 203 and the scavenging grooves 215. The projection 217 engages with a sealing groove 219 provided on the case flange 211. A liquid packing 221 is filled in the sealing groove 219. Shaft like positioning pieces 223 are cast integrally with the engine cylinder 5 and project from the flange surface of the cylinder flange 209 to engage with positioning holes 225 which are cast integrally with the flange surface of the case flange 211.

The piston 7 is freely slidable within the engine cylinder 5 and connected with the connecting rod 9 with a piston pin 229. The other end of the connecting rod 9 is rotatably supported by a crank arm 235 of the crank shaft 3 through a crank pin 237.

To assemble the engine cylinder 5 with the crankcase 1, the piston 7 is firstly fitted to the crank shaft 3 through the connecting rod 9. The piston is then inserted into the engine cylinder 5 after which spigot portion 207 is inserted into the opening 203 of the crankcase 1. The liquid packing 221 is filled in the sealing groove 219. The positioning pieces 223 are engaged with the positioning holes 225, and the cylinder flange 209 is fixed to the case flange 211 by the bolts 213.

Figure 12:
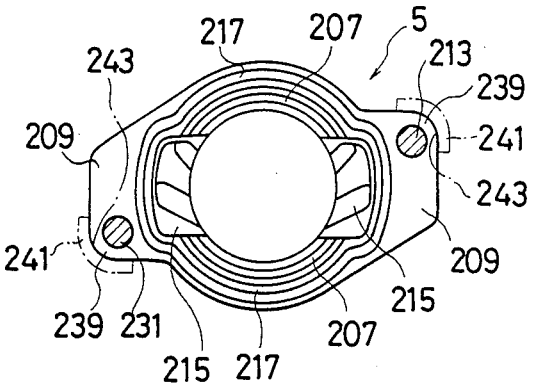
FIG. 12 is a plan view showing a modification of the positioning projection and hole.

FIG. 12 shows a modification of the above arrangement. Corner portions of the cylinder flange 209 are used as positioning pieces 239 which are engaged with positioning holes 243 formed on inner surfaces of positioning member 241 provided on the case flange 211. The positioning members 241 may surround the cylinder flange 209, or a positioning recess corresponding to the circumference of the cylinder flange 209 may be formed on the case flange 211.

Figure 13:
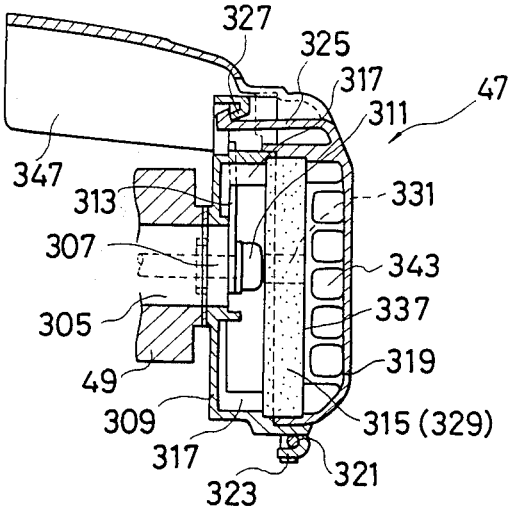
FIG. 13 is a cross-sectional view showing the details of an air cleaner of the portable engine.
Figure 14:
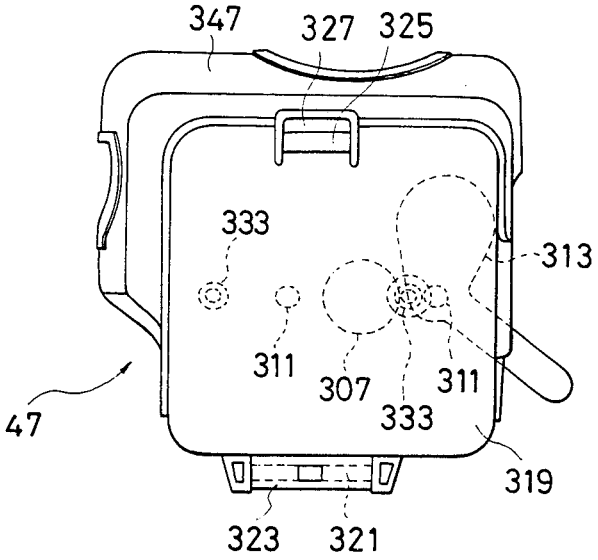
FIG. 14 is an external view showing the air cleaner.
Figure 15:
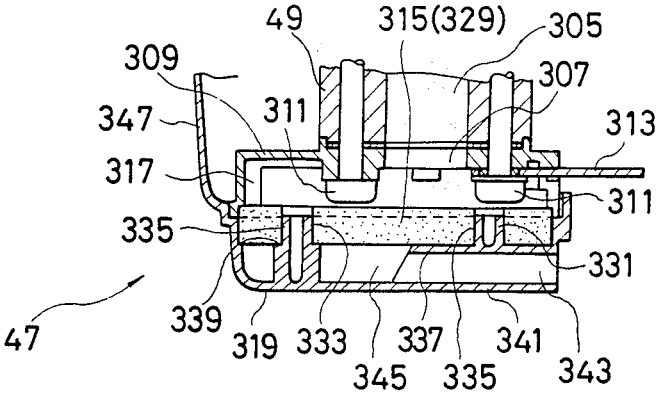
FIG. 15 is a cross-sectional plan view showing the air cleaner.

FIGS. 13 to 15 show the details of the air cleaner 47. A main casing 309 of the air cleaner 47 has an opening 307 which communicates with a suction port 305 of the carburetor 49. The casing 309 is fixed to the carburetor 49 with bolts 311. A choke valve 313 is fitted by a bolt 311 and opens and closes the opening 307. Ribs 317 are formed inside the casing 309 to support a felt like or sponge like porous filter 315. A cap casing 309 is removably fitted at its lower end to a fitting portion 323 of the main casing 309 by a fitting pin 321 to hold the filter 315. A hook 325 projecting from the top of the cap casing 319 is stopped by a stopping portion 327 of the main casing 309 due to the resiliency. A space 329 for receiving the filter 315 is formed in the cap casing 319. Supports 331 and 333 projecting inside the cap casing 319 are removably inserted into holes 335 which are formed to pass through the filter 315. The filter 315 is held by a partition 337 for separating a part of the interior of the cap casing 319, by a step 339 of the support 333, and by the main casing 309. A muffling chamber 343 is formed between the cap casing 319 and an outer wall 341 to communicate a chamber 345 of the cap casing 319 with the atmosphere. A cover 347 for covering the top of the carburetor 49 is fixed to the upper part of the cap casing 319.

According to the above arrangement, air from the atmosphere enters into the chamber 345 through the muffling chamber 343 according to the suction force of the engine, and is sucked by the suction port 305 of the carburetor 49 through the filter 315 and the opening 307. The filter 315 may be removed by removng the hook 325 from the stopping portion 327 with fingers and by turning the cap casing 319 around the pin 321. The filter 315 is then taken out and cleaned. To install the filter 315, the cap casing 319 is kept opened, and the fitting holes 335 of the filter 315 are pushed toward the supports 331 and 333 of the cap casing 319 to place the filter 315 in the space 329. After that, the cap casing 319 is closed, and the hook 325 is engaged with the stopping portion 327.

Figure 16:
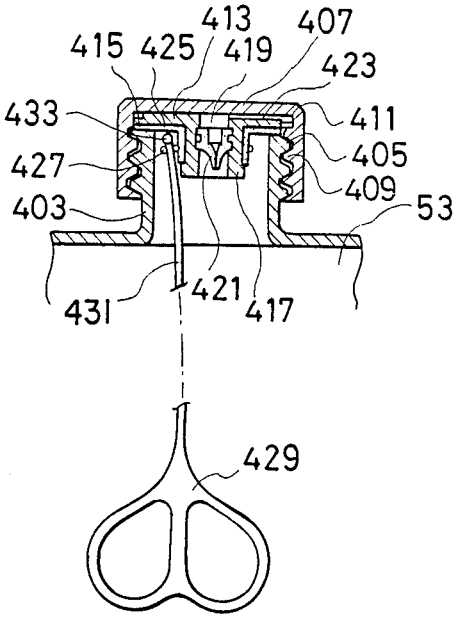
FIG. 16 is a cross-sectional view showing the details of a cap portion of a fuel tank of the portable engine.
Figure 17:
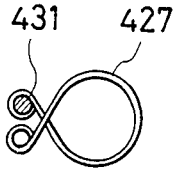
FIG. 17 is a view showing a snap ring adopted for the cap portion shown in FIG. 16.

FIGS. 16 and 17 show the details of the fuel tank 53. A cylindrical filler port 403 projects from the fuel tank 53 and has a threaded portion 405 formed around the filler port 403. A female thread 409 of a a cap 407 is screwed to the threaded portion 405. A groove 411 is formed at an end of the female thread 409 and engages with a projection 415 projecting from the periphery of a supporting plate 413. The supporting plate 413 has a cylindrical portion 417 which extends downward at the center of the plate 413 and has an inner diameter portion 419 to which a breather valve 421 made of resilient member is attached. The breather valve 421 allows only downward communication. A vent groove 423 is provided at the upper surface of the supporting plate 413 to communicate the inner diameter portion 419 with the groove 411. A packing 425 made of rubber is disposed between the end face of the filler port 403 and the supporting plate 413. The center of the packing 425 is formed in a cylindrical shape and fitted around the cylindrical portion 417 of the supporting plate 413. A snap ring 427 presses the periphery of the cylindrical portion of the packing 425 against the cylindrical portion 417 of the supporting plate 413. A flat stopper 429 made of soft synthetic resin is inserted into the fuel tank 53 and not able to pass through the filler port 403 due to its size. A cord 431 is formed integrally with the stopper 429 and has a spherical stopping portion 433 which is engaged with the snap ring 427.

According to the above arrangement, the packing 425 will seal the filler port 403 when the cap 407 is fastened. If pressure in the fuel tank 53 is decreased due to the consumption of fuel, the atmosphere is introduced into the fuel tank 53 through a gap between the threads 409 and 405, the groove 411, the vent groove 423, the inner diameter portion 419, and the breather valve 421. When the cap 407 is removed to fill fuel, the stopper 429 is stopped by the inner side of the filler port 403 and hung by the cord 431 so that the cap 407 is not lost.

Figure 18:
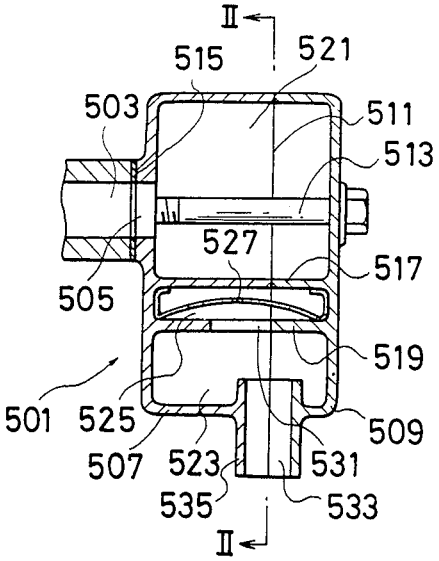
FIG. 18 is a cross-sectional side view showing the details of a muffler of the portable engine.
Figure 19:
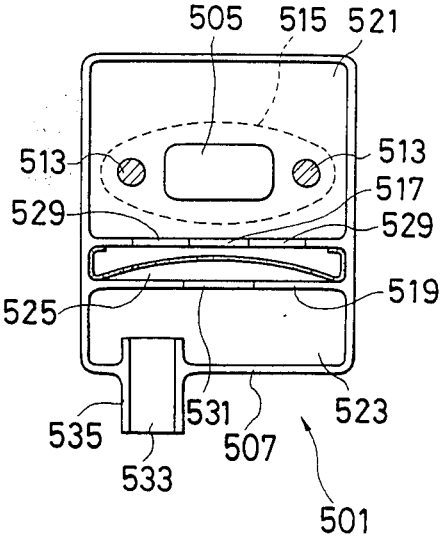
FIG. 19 is a cross-sectional front view showing the muffler.
Figure 20:
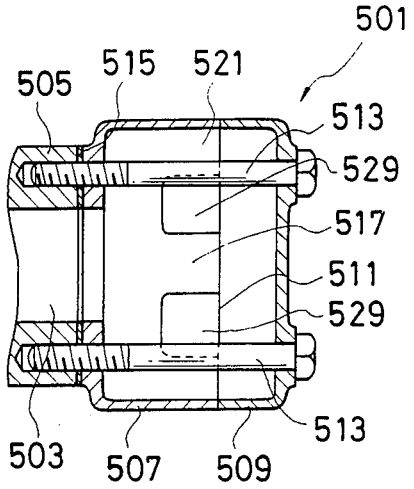
FIG. 20 is a cross-sectional plan view showing the muffler.

FIGS. 18 to 20 show the details of a muffler disposed in the muffler cover 51. A muffler case 501 comprises a main case 507 and a cap case 509. The main case 507 has a communication hole 505 which communicates with an exhaust port 503 of the engine. The main case 507 and the cap case 509 are fitted together by bolts 513 along a dividing plane 511 which is orthogonal to the exhaust port 503, and fixed to a fitting surface 515 located around the exhaust port 503. The inside of the muffler case 501 is divided into a first muffling chamber 521 and a second muffling chamber 523 by two partitions 517 and 519 which are orthogonal to the dividing plane 511. A separation chamber 515 is formed between the first and second muffling chambers 521 and 523. A spark preventive net 527 made of metallic material is inserted into the separation chamber 525 and held by the cap case 509 and the main case 507. The spark preventive net 527 is formed in a curved shape. Communication holes 529 and 531 are formed on the partitions 517 and 519 respectively. The second muffling chamber 523 communicates with the atmosphere through an exhaust pipe 535 having an exhaust hole 533. The exhaust pipe 535 comprises two portions formed integrally with the main case 507 and the cap case 509 respectively, the two portions being assembled together along the dividing plane 511.

According to the above arrangement, an exhaust gas from the engine passes through the exhaust port 503 and the communication hole 505, enters into the first muffling chamber 521, expands in the chamber 521, is contracted by the communication holes 529 and 531, enters into the second muffling chamber 523, expand again in the chamber 523, is again contracted by the exhaust pipe 533, and finally discharged to the atmosphere. An exhaust noise is silenced due to the expansion and contraction and the interference by the lengthly exhaust pipe 533. Fire caused by carbon is prevented by the spark preventive net 527 from escaping to the atmosphere.

Figure 21:
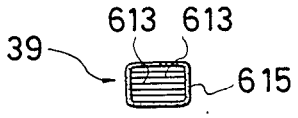
FIG. 21 is a cross-sectional view showing an iron core for an ignition coil of the portable engine.

FIG. 21 is a cross-sectional view showing the iron core 39 which comprises a plurality of core plates 613. The outer surface of the iron core 39 is covered by a synthetic resin film 615.

What is claimed is:

1. A portable engine comprising:

a crankcase;

an engine cylinder disposed within said crankcase;

a cylinder cover for said engine cylinder;

a fan connected with said engine cylinder;

a fan cover fixed to a front surface of said crankcase to cover said fan and direct a blown stream of air toward said engine cylinder, said fan cover being disposed adjacent said cylinder cover and forming a step therebetween;

a partition plate formed integrally with said crankcase to cover said step formed between said fan cover and said cylinder cover; and an ignition coil for said engine cylinder fixed to said partition plate;

wherein said fan cover is provided with an opening located at a position corresponding to a position where said ignition coil is disposed, and a cover plate removably fitted to said fan cover to cover said opening.

2. A portable engine as claimed in claim 1, wherein said crankcase is provided with a flange for fixing said fan cover and said cylinder cover, a front fitting surface of said flange being formed to match the entire circumference of said fan cover, and said cylinder cover being fixed to a rear fitting surface of said flange.

3. A portable engine as claimed in claim 1, wherein said cylinder cover is provided with stopper holes and said fan cover with stopper nails which are inserted into said stopper holes respectively, said cylinder cover being removably fitted to said fan cover through the engagement between said stopper nails and holes.

4. A portable engine as claimed in claim 1, wherein said fan cover is provided with stopper holes and said cylinder cover with stopper nails which are inserted into said stopper holes respectively, said cylinder cover being removably fitted to said fan cover through the engagement between said stopper nails and holes.

5. A portable engine as claimed in claim 2, wherein said cylinder cover is provided with stopper holes and said flange with stopper nails which are inserted into said stopper holes respectively, said cylinder cover being removably fitted to said flange through the engagement between said stopper nails and holes.

6. A portable engine as claimed in claim 2, wherein said flange is provided with stopper holes and said cylinder cover with stopper nails which are inserted into said stopper holes respectively, said cylinder cover being removably fitted to said flange through the engagement between said stopper nails and holes.

* * * * *